United States Patent [19]

Storer, Jr.

[11] 4,228,756

[45] Oct. 21, 1980

[54] CATAMARAN TILLER-CROSSBAR CONNECTOR

[75] Inventor: John E. Storer, Jr., Indianapolis, Ind.

[73] Assignee: Sailing Systems, Inc., Lexington, Tenn.

[21] Appl. No.: 8,695

[22] Filed: Feb. 1, 1979

[51] Int. Cl.[3] ..... B63H 25/00

[52] U.S. Cl. ..... 114/144 R; 74/480 B; 114/162; 114/163; 403/56

[58] Field of Search ..... 114/144 R, 162, 163, 114/172, 61; 115/18 R; 403/59, 90, 115, 143; 74/480 R, 480 B, 544, 479

[56] References Cited

U.S. PATENT DOCUMENTS

| | | | |
|---|---|---|---|
| 2,365,490 | 12/1944 | Pieron | 114/144 R X |
| 2,543,553 | 2/1951 | McAllister | 114/144 R X |
| 3,174,357 | 3/1965 | Conklin | 115/18 R X |
| 3,197,552 | 7/1965 | Flair | 403/143 X |
| 3,388,611 | 6/1968 | Clary et al. | |
| 3,903,830 | 9/1975 | Tanzer | 114/162 |
| 3,955,438 | 5/1976 | Zakrzewski | 114/144 R X |
| 4,027,614 | 6/1977 | Jones | 114/163 |
| 4,082,053 | 4/1978 | Woodward | 114/163 |

*Primary Examiner*—Edward R. Kazenske

*Attorney, Agent, or Firm*—Woodard, Weikart, Emhardt & Naughton

[57] ABSTRACT

A tiller-crossbar connector for catamaran rudder control includes a central bolt member passing through a spherical nylon member at one end and through a hemispherical nylon member at the opposite end with a spring member disposed between the two nylon members. Each nylon member is positioned within the bolt-retaining recess of a corresponding standard end cap and the spherical curvatures of these nylon members conform to the hemispherical curvature of the standard bolt-retaining recess. With the spring member disposed between these two end caps, the entire connector and end cap assembly is able to be tightly clamped together by means of a nut threadedly received on one end of the central bolt member. Since the force vectors acting between the spherical nylon member and its corresponding end cap are greater than the force vectors acting between the shaft portion of the central bolt member and the clearance hole of the spherical nylon member, relative motion between the two end caps occurs at this cylindrical interface rather than at the exterior spherical interface. This single point of motion provides a no-backlash system and the specific spherical nylon member and spring combination provide a sensitive feel throughout all steering force requirements and wind conditions.

14 Claims, 5 Drawing Figures

CATAMARAN TILLER-CROSSBAR CONNECTOR

BACKGROUND OF THE INVENTION

This invention relates in general to connector devices and in particular to catamaran tiller-crossbar connectors.

Rudder manipulation of catamarans involves a linkage arrangement of a hiking stick connected to a crossbar and of the crossbar connected to tiller arms; there being one tiller arm-rudder assembly hinged to the transom of each hull portion. The tiller arm-rudder assembly is arranged for different planes of movement such that conventional steering of both rudders may be performed simultaneously by the crossbar while still enabling one rudder to "kick up" independently of the other when encountering an obstacle. Each end of the crossbar is fitted with a standard end cap and the adjacent end of the corresponding tiller arm is similarly provided with an identically styled end cap.

In order to permit the requisite variety and freedom of movement between crossbar and tiller arm, these adjacent end caps are held together by means of a connector. Since such connectors are subjected to a number of different force vectors of varying directions and magnitude during any sailing excursion of the catamaran, resistance to wear, durability, responsive control of the rudders and the ability to permit free movement of the crossbar and the tiller arm are important design factors of any suitable tiller-crossbar connector. Another factor to consider is that the standard end caps must be used, unchanged, in accordance with Hobie Class Association Racing Rules, in order for the catamaran to be of a "legal" design.

The following listed patents disclose construction concepts for sailboat steering systems which are representative of prior art attempts:

| Patent No. | Patentee | Issue Date |
|---|---|---|
| 4,082,053 | Woodward | 4/04/78 |
| 4,027,614 | Jones | 6/07/77 |
| 3,388,611 | Clary et al. | 6/18/68 |

Woodward discloses a catamaran with pivoting stern rudders which may be controlled by a crossbar connected to corresponding rudder tillers by means of inwardly offset pivots. While there is no specific reference to the design of the pivots, it is clear that standard end caps are not used and that the pivots are not arranged in any unique manner so as to accommodate the force vectors which act on the connector.

Jones discloses a sailboat construction which includes a retractable hydrofoil design. The crossbar connection to the rudders is by means of fixed tiller arms. Jones requires only a slight tilting of one rudder's pivot axis relative to the other to permit adjustment of position of the hydrofoils.

Clary et al. discloses a hinge connector for a control linkage which includes a plastic connector member having tubular end portions for receiving the free ends of a link and a lever having a reduced intermediate section forming a flexible hinge that permits relative pivotal movement between the lengths upon actuation of the linkage. The connector is a one-piece molded body of plastic or suitable elastic material and while the invention claims that the material used to be of suitable resilience and fatigue strength, the application is with a motor vehicle throttle control system and not with a catamaran. Consequently, the variety of force vectors associated with the motor vehicle are not as varied as with a catamaran and thus the hinge connector of this patent is of only limited relevancy.

Additionally, other currently used connectors are generally only one of two styles. The first style involves the use of a single synthetic disc placed between adjacent end cap surfaces and a straight bolt clamping the assembly together. Hemispherical members which conform to the interior recessed area contour of the end caps are used and a spring is disposed between a nut on the end of the bolt and one of the hemispherical members. The second style is virtually the same except that the single disc is replaced by two synthetic plate-like members which have abutting flat surfaces on one side and on the opposite sides, curved surfaces which fit the contour of the exterior surface of the end caps.

One disadvantage with these currently used styles is that with the spring tension set loose, the connectors have a double-jointed characteristic wherein the connector is allowed to pivot or swivel at both tiller and crossbar adjacent end caps. This double-jointed characteristic affects rudder-to-rudder alignment and when in steering a torque force vector is introduced into the crossbar by means of the hiking stick and there can be a feeling of backlash or lost motion in the steering system, whereas no-lash control is highly desirable. In the event the spring is tightened, such as to a fully compressed state, the backlash and double-jointedness can virtually be eliminated, but a disadvantage with this procedure is that the friction forces within the connector increase greatly and affect steering control when in light air and when the force required to steer is relatively low. In these conditions, a nearly frictionless feel is desirable. Another, and major, disadvantage of present connectors, exacerbated when tightened so that there is little or no spring play, is in the tendency to deform or fail both themselves and the end caps due in part to insufficient universal accommodation. Such universal accommodation is particularly needed when turning rudders to the maximum, resulting in an upturned tiller arm and its corresponding end cap becoming angularly disposed to the horizontal adjacent crossbar end cap, as single plane tiller arm and crossbar positioning is approached. Force from this extreme and insidious mechanical advantage elongates the end cap holes through which the bolt extends, and may even bend bolts or fracture end caps. It would be an improvement to such connector designs to structure connectors not susceptible to double-jointedness nor to the above prizing, and free of any feeling of backlash as well as providing a sensitive feel when in light air and when the force required to steer is relatively low. The design disclosed herein achieves these advantages as will be apparent from the description which follows.

SUMMARY OF THE INVENTION

A tiller-crossbar connector for connecting together a tiller arm and an adjacent crossbar end cap for catamaran rudder control according to one embodiment of the present invention comprises a central shaft member extending through the cross-bar end cap, a part-spherical pivot member slidably received by the central shaft member and positioned between one end of the central shaft member and the end cap, means for anchoring the central shaft member to said tiller arm and spring means disposed about the central shaft member between the end cap and the tiller arm.

One object of the present invention is to provide an improved tiller-crossbar connector for catamarans.

Related objects and advantages of the present invention will be apparent from the following description.

DESCRIPTION OF THE PREFERRED EMBODIMENT

Figure 1:
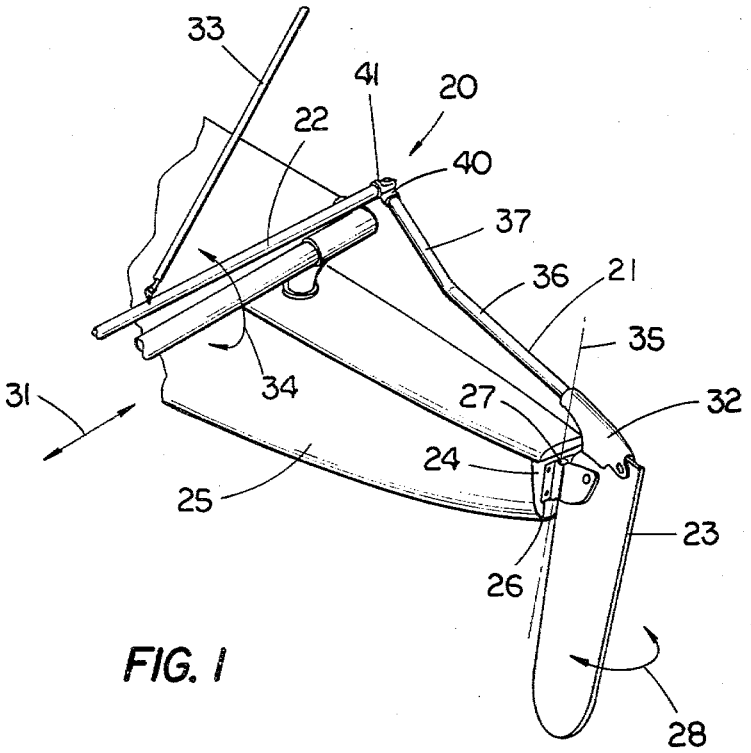
FIG. 1 is a partial perspective view of a catamaran including a tiller-crossbar connector according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated a portion of a conventional catamaran which includes a tiller-crossbar connector 20 disposed between tiller arm 21 and crossbar 22. Although a conventional catamaran typically has two hulls, each with a rudder assembly and tiller arm, only one such assembly is illustrated in FIG. 1 and it is to be understood that crossbar 22 does in fact connect to a virtually identical rudder and tiller arm assembly by means of an identical connector 20 adjacent the opposite hull. Rudder 23 is attached to the transom 24 of hull 25 by means of hinge assembly 26. Hinge assembly 26 includes a hinge pin 27 which permits pivotal movement of rudder 23 in either direction from a neutral position as is indicated by arrow 28. Although not specifically illustrated, it is to be understood that movement of crossbar 22 in the direction of arrow 31 results in turning both rudders 23 in a controlled rudder-to-rudder alignment pattern such that appropriate steering of each hull 25 is performed simultaneously.

Each tiller arm 21 attaches to each rudder 23 by means of a clamp assembly 32 which although bolted to the rudder head is horizontally hinged with the rudder head as part of the same mechanism thereby permitting either rudder to "kick up" independently of the other when meeting a particular obstacle. Above the approximate midpoint of crossbar 22, there is connected, by a pivotable yoke, a hiking stick 33 which is used by the helmsman in order to position the rudders in a desired orientation. During a particular sailing excursion, a great variety of forces are applied to the hiking stick coincident with the stick being swiveled through a wide range of horizontal and vertical angles relative to crossbar 22. Although to effect steering involves only movement of crossbar 22 in the direction of arrow 31, in this accomplishment there are generated various torque force vectors in the direction of arrow 34 and such force vectors further complicate the force loading on tiller-crossbar connector 20.

The hinge pin axis is represented by vertical line 35 and althrough the majority of rudder motions will be about this particular axis of rotation, the respective movements between tiller arm 21 and crossbar 22 at the location of the tiller-crossbar connector 20 involve a much more complicated and varied set of movements. While tiller arm 21 may extend in a straight manner throughout its entire length, a more common occurrence is that a first portion 36 extending from the rudder head is straight and integral therewith is second portion 37 which is bent upwardly at an angle 38 (see FIG. 5) of as much as 40 degrees. Both tiller arms are also bent toward center (toward each other) such that the overall length of crossbar 22 is shorter than the distance between the two hinge pins (axis lines 35). The overall steering linkage is analogous to the Ackerman steering system for cars, trucks, etc. It is also to be noted that the rudder on the hull which is nearer to the center of the turn is rotated more than the other rudder.

Figure 2:
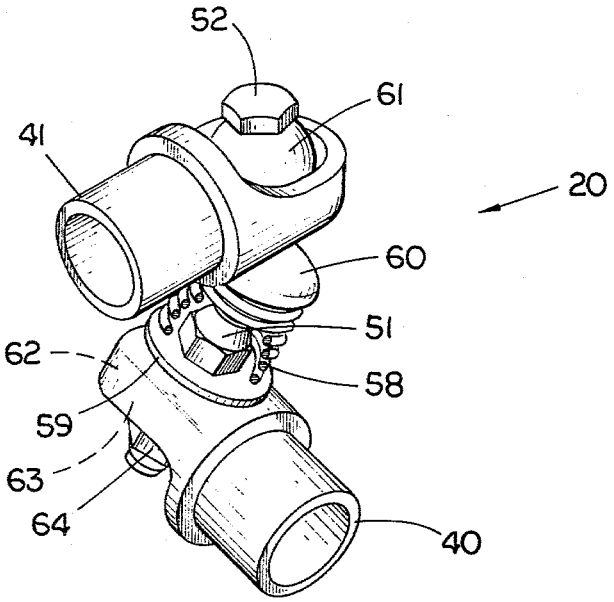
FIG. 2 is a fragmentary perspective view of the FIG. 1 tiller-crossbar connector, enlarged over FIG. 1, as connected to standard end caps.
Figure 4:
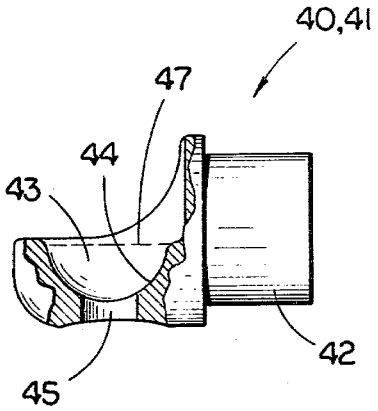
FIG. 4 is a fragmentary side elevation view of a FIG. 2 standard end cap.

Disposed in the end of second portion 37 of tiller arm 21 is a standard end cap 40 and similarly in the end of crossbar 22 is standard end cap 41. In the FIG. 2 illustration, these end caps have been removed from their respective attaching members and this figure reveals the assembly of the tiller-crossbar connector 20 to these adjacent standard end caps. FIG. 4 provides yet another view of these standard end caps and end caps 40 and 41 are virtually identical to each other as well as to the end caps used at the second and opposite tiller-arm-to-crossbar point of connection. For the purposes of simplification, the FIG. 4 illustration will be described in detail, it being understood that such description applies to all standard end caps associated with the subject invention. Standard end cap 40 includes a tubular end portion 42 which is inserted into the open tubular end of its corresponding connecting member. Opposite this end is the tiller-crossbar connector receiving portion including a hemispherical recess 43 which is defined by generally hemispherical surface 44 smoothly flared out above its great circle terminus line 47, and at the bottom of which is bolt clearance hole 45. In order for recess 43 to provide a clearance zone or depression in which the ends of the tiller-crossbar connector may be retained, it follows that standard end cap 40 is oriented oppositely to standard end cap 41 as is illustrated in FIG. 2. A further constraint concerning standard end caps 40 and 41 is that these end caps must be used, unchanged, in accordance with Hobie Class Association Racing Rules in order for the catamaran to be of a "legal" design. Therefore, the disclosed tiller-crossbar connector 20 is structurally arranged in the exemplary embodiment so as to be compatible with standard end caps.

Figure 3:
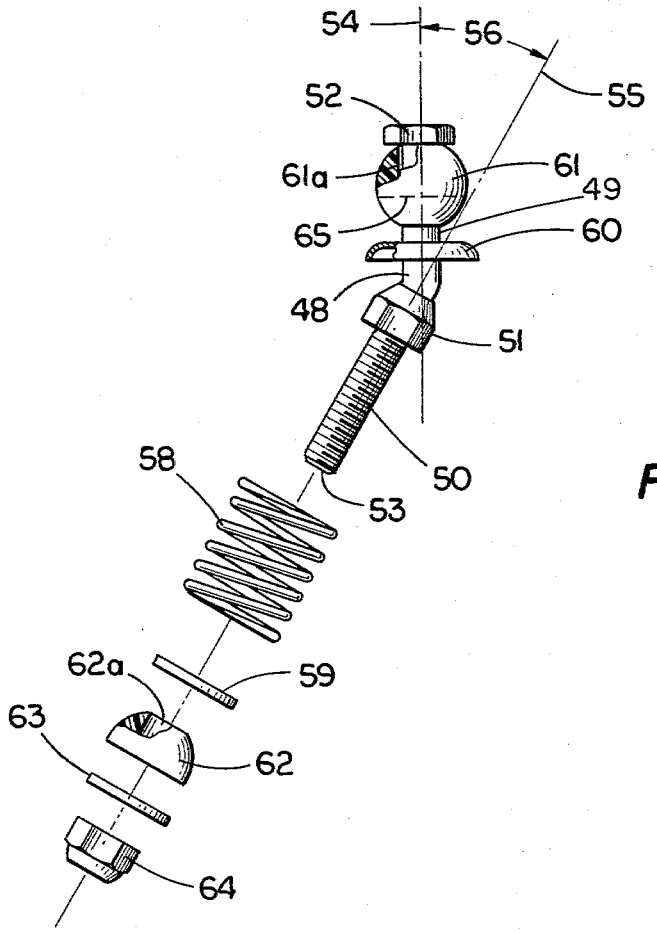
FIG. 3 is a partially exploded fragmentary view of the FIG. 1 tiller-crossbar connector absent the FIG. 2 end caps.

Referring then to FIGS. 2 and 3, tiller-crossbar connector 20 is illustrated in greater detail. Tiller-crossbar connector 20 includes a central shaft member 48 which is structurally arranged into a first or top portion 49 and a second or lower portion 50. Top portion 49 is a smooth cylindrical surface generally extending from the location of threaded-on nut member 51 to bolt head 52. Lower portion 50 is externally threaded and extends from the general location of threaded-on nut member 51 to free end 53. Axis line 54 represents the cylindrical axis of top portion 49 and axis line 55 represents the cylindrical axis of lower portion 50 and their angular divergence is designated as angle 56. Tiller-crossbar connector 20 further includes spring member 58, washer 59, dished retainer 60, spherical pivot member 61, hemispherical member 62, washer 63 and nut 64. Dished retainer 60 is disposed between end cap 41 and spring member 58 while washer 59 is disposed at the underface of nut member 51 and also at the opposite end of spring member 58 adjacent end cap 40. Threaded-on nut member 51, when advanced to its furthest extent on lower portion 50, becomes positioned around the junction of top portion 49 and lower portion 50. Nut member 51 serves as a pilot for spring member 58 while strengthening central shaft member 48 by effectively shortening the cantilevered shank length of the top portion 49 extending above end cap 40. Spherical pivot member 61 and hemispherical member 62 have central clearance holes **61*a* and 62*a*, respectively, therethrough. The top portion 49 of central shaft member 48 extends through clearance hole 61*a*, and it is to be understood that there is a close but free rotary bearing-class fit between top portion 49 and the inside diameter surface of hole 61*a***.

Referring to FIGS. 3 and 4, the particular size and curvature of the spherical surfaces of members 61 and 62 which may be of nylon or similar material, are such that their radii slightly exceed the radius of the hemispherical surface 44 of the standard aluminum end caps 40 and 41 so that member 61 bears only on terminus line 47 of recess 43 as does member 62 (with respect to end cap 40) prior to tightening nut 64. With pivot member 61 so disposed, moderate degrees of universal motion are permitted between central shaft member 48 and end cap 41. In the assembled configuration with the standard end caps, tiller-crossbar connector 20 is installed such that as nut 64 is advanced and then tightened onto bottom portion 50, spring 58 is compressed to a working height which is predetermined by the position of the underface of nut member 51, as this nut member bottoms out on spring-seating washer 59 which in turn is contacting end cap 40. Continued rotation of nut 64 into a tight clamping position thrusts nut 64 against washer 63 which thrusts and firmly embeds hemispherical member 62 into recess 43 of this tiller end cap. This nut-to-nut tightening (64 to 51) tensions threaded portion 50 which becomes rigidly attached to end cap 40 and which also anchors upper portion 49 to this end cap. Spring 58 at its working height is further bounded as it thrustably lifts retainer 60 and in turn end cap 41 whose recess 43 terminus line 47 makes instantaneous contact about broken line 65 of spherical pivot member 61. This action in turn lifts or forces upwardly member 61 such that it bears against the underside of bolt head 52. This controlled spring-load contact of terminus line 47 to broken line 65 is particularly important to the concept of this invention, and will be further elaborated upon. The spring-enforced contact grouping of crossbar end cap 41 and spherical pivot member 61 about bolt portion 49 and at the bolt head 52, along with the rigid projection of this bolt portion from end cap 40 and its tiller arm, establishes all pivoting movement between end caps to be from the center of sphere 61 which lies at a fixed point on axis line 54 of bolt portion 49. Thus, all pivoting of tiller-crossbar connector 20 is universal about this fixed center point, whether effected between end cap 41 and spherical pivot member 61, between member 61 and bolt portion 49, or by movements within both contacts in concert, while yielding the equivalent of single-joint action rather than the undesirable double-jointedness of prior constructions.

Now to be described is how under spring load this dual pivoting capability provides low-friction steering in combination with relatively high friction rotation of crossbar 22 in the direction of arrow 34. First, if only steering forces along the axis of crossbar 22 were to be imposed, and felt at the equator of spherical pivot member 61 and at right angles to axis line 54, a typical ratio of approximately 2.5:1 of the outside diameter of spherical pivot member 61 to its cylindrical inside diameter (such as 0.63 to 0.25) would preferentially induce cylindrical rotation only, because of the simple mechanical advantage due to the 2.5:1 ratio, equal friction coefficients being assmed for both contacts. In actual practice and for all practical purposes, steering-induced rotation in the direction of arrow 34 of the cross bar tilts terminus line 47 and coinciding band 65 thereby making good the number of 2.5:1 as a minimum ratio, before imposition of any spring-load effects.

Now consider the spring-load effects only. Although the near equatorial band (broken line) 65 on spherical pivot member 61 must rock or precess to maintain its identity with terminus line 47 of cavity 43 throughout all connector 20 motions, the following load distribution analysis holds closely enough so as not to require amplification for all instantaneous alignments of band 65 relative to axis line 54. Assume that the spring load exerted along axis line 54 applies equal force on band 65 as well as on the underside of the head of bolt 52 against spherical pivot member 61. Again, typically while holding with the proportions of the previous example, assume that spherical pivot member 61 has a radius of approximately 0.313 inches and that the centroidal radius of contact of the spherical pivot member 61 to the underside of bolt head 52 is 0.135 inches and the cone shape which is tangent to the contact band has an included angle of 28 degrees (a half angle of 14 degrees). The spring-load force then is direct on the underside of bolt head 52 yet is wedged on the contact band. By cone clutch analogy it should be understood that the normal load on spherical pivot member 61 is equal to the spring-load force along axis line 54 times the inverse of the sine of the half angle (14 degrees) which at the contact band radius equals the product of (0.313) times (cosine 14 degrees). It follows then that the mechanical advantage in the axial direction may be expressed as the product: (0.313) times (cosine 14 degrees) divided by the product: (0.135) times (sine of 14 degrees) which equals 9.29. In other words, under spring loading, more than nine times as much torque is needed to rotate spherical pivot member 61 on each contact with terminus line 47 of recess 43 as is needed to rotate the cylinder (top portion 49) within hole **61*a* of spherical pivot member 61. As forces other than axial forces are added in the act of steering, the net effective mechanical advantage becomes vectorially intermediate between the typical example of 9.29 as a factor and the earlier stated ratio of approximately 2.5. This mathematical comparison indicates why, when the only movement required is pivoting motion normal to axis line 54, the sole point of movement is between the smooth cylindrical surface of top portion 49 and hole 61*a*. Furthermore, as universal action is required, the entire rotational component remains on this cylindrical surface, the shifting of spherical pivot member 61 (contact band 65) with respect to terminus line 47 being of a rocking nature only in order to complete the universal action. Also, a part of this overall movement interaction is the fact that a small frictional force is required in order to rotate dished retainer 60 at its spring-loaded point of contact on end cap 41. This aspect slightly detracts from the low-friction steering objective yet it adds friction which advantageously resists rotation of crossbar 22 in the direction of arrow 34**.

While mention has been made of the fact that pivot member 61 is spherical in shape, it is to be understood that clearance hole 61*a* actually results in a part-spherical shape. Furthermore, it is to be understood that the mathematical and force relationships previously expressed require only that pivot member 61 be generally spherical in that area through which line 65 precesses. Since the shape of member 61 is only required to be spherical in the full territory of precession of line 65, the overall shape is more accurately described as part-spherical.

Another aspect which should be mentioned is that nut 64, washer 63 and hemispherical member 62 serve to anchor central shaft member 48 to end cap 40. While this arrangement is preferred due to its conventional nature and the compatible geometry of member 62 and the end cap recess 43, any number of anchoring means may be suitable for this attachment. In the event end cap 40 is not present but rather that the attachment is made directly to the tiller arm, then member 62 would not be necessary and other anchoring means could be used instead.

While a design objective is for spring member 58 to be installed with a preestablished load height, it will be apparent that by varying the position of nut member 51 along the length of lower portion 50, there is provided the option of an adjustable spring height and thus an adjustable spring load. In any event, the combination of single-jointedness, of spring-loading, plus the revealed mechanical advantage relationship provides the desired balance of sensitivity, low-friction steering, firmly maintained rudder alignment, and relatively high frictional resistance to hiking stick induced rotation of crossbar 22 in the direction of arrow 34, sufficient to offset any feeling of lost motion from such rotation.

Figure 5:
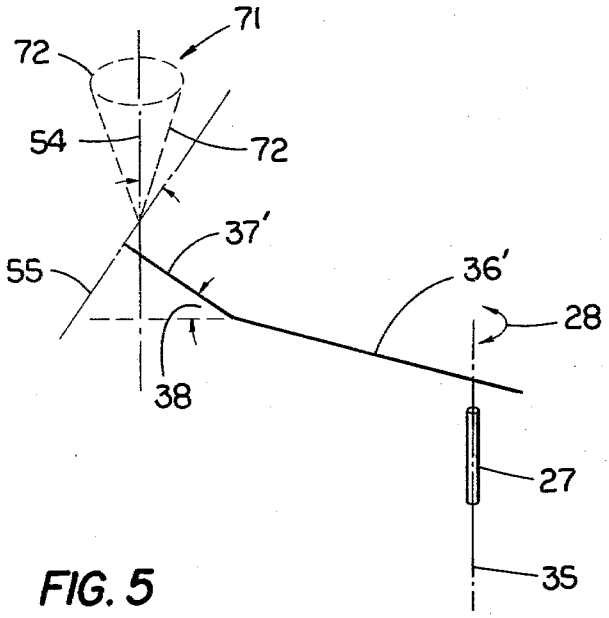
FIG. 5 is a schematic diagram of various axis lines associated with the FIG. 1 catamaran and tiller-crossbar connector.

In FIG. 5, axis line 54 is illustrated as being in a plane with and parallel to axis line 35 of rudder hinge pin 27 and axis line 55 is at a nominal right angle to upturned tiller arm axis line 37' (and end cap 40). A quasi-elliptical cone 71 is depicted by broken lines 72 and its apex coincides with the intersection of axis lines 54 and 55 of FIG. 3. This quasi-elliptical cone represents a tolerance envelope for axis line 54 with respect to axis line 55 (angle 56) for a given angle 38 and still retain full observance of the objectives of the present invention including being free of any prizing of the kind described in the background of the invention, as well as freely allowing a rudder to "kick up" or to be lifted manually, upraising tiller arm 21 on either rudder singularly, all within the universal capability of interacting connectors 20. Angle 38 may vary between different catamaran sizes and manufacturers, and since axis line 55 is substantially perpendicular to axis line 37', the size of angle 56 governs the extent to which axis line 54 is parallel to the hinge pin axis line 35. Cone 71 is intended to illustrate that for any given angle 38, angle 56 has a certain plus and minus range from the ideal angular value which would cause axis line 54 to be parallel to axis line 35. This permits a single connector style to be appropriate for use on a variety of catamarans. It should also be clear that if axis line 37' should lie so that angle 38 becomes closed, then angle 56 would not exist (in the ideal parallel arrangement) and thus, the central shaft member would not be bent between portions 49 and 50. With connectors always fabricated and installed not to exceed the limits so described and thereby avoiding the described destructive prizing, low normal forces and loads are the rule with predictable life and reliability improvement over present connectors.

While a variety of specific mechanical components may be utilized in combination with spring member 58, part-spherical pivot member 61 and central shaft member 48, it is these members and their specific structure which contribute predominantly to the advantages of this connector invention over those concepts of prior devices. Similarly, while preferred materials for spherical pivot member are nylon or Delrin, with the remaining components being of a steel or similar durable metal, an important aspect of the materials selection process is that the coefficient of friction between part-spherical pivot member 61 and the corresponding standard end cap be approximately the same as the coefficient of friction between the surface of hole 61*a* and the outer surface of top portion 49, so that the typical mechanical advantage numbers derived herebefore are not greatly altered due to differences in such frictional coefficients.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A tiller-crossbar connector for connecting together a tiller arm and an adjacent crossbar end cap for catamaran rudder control which comprises:

a recess in said end cap;

a central shaft member extending through said crossbar end cap;

a part-spherical pivot member slidably received by said central shaft member and positioned between one end of said central shaft member and said crossbar end cap;

means for anchoring said central shaft member to said tiller arm;

spring means disposed about said central shaft member and acting between said end cap and said tiller arm to urge said pivot member into said end cap recess; and said central shaft member having a first portion of a smooth cylindrical surface and a second portion externally threaded, said first portion extending through said part-spherical pivot member, and said first and second portions having axes which are arranged at an angle to one another.

2. The tiller-crossbar connector of claim 1 wherein said crossbar end cap recess is a hemispherical recess, said part-spherical pivot member being suitably sized to fit within said hemispherical recess and to make near equatorial line contact therewith.

3. The tiller-crossbar connector of claim 2 in which said central shaft member further includes an enlarged head portion at said one end for retaining said part-spherical pivot member within said hemispherical recess.

4. The tiller-crossbar connector of claim 2 wherein said part-spherical pivot member is arranged with respect to said crossbar end cap hemispherical recess and with respect to said central shaft member so that two types of movement of part-spherical pivot member are permitted.

5. The tiller-crossbar connector of claim 4 wherein one type of movement is rotational movement about said central shaft member and the other type of movement is rolling movement within said hemispherical recess.

6. The tiller-crossbar connector of claim 5 wherein said part-spherical pivot member is sized and arranged relative to said central shaft member and relative to said hemispherical recess such that less force is required for rotational movement than for rolling movement.

7. The tiller-crossbar connector of claim 1 wherein said tiller arm is arranged with a tiller end cap, said anchoring means arranged for lockably attaching to said tiller end cap, said anchoring means includes a nut and washer arrangement for clamping against opposite surfaces of said tiller end cap.

8. The tiller-crossbar connector of claim 7 wherein said nut and washer arrangement comprising a pair of nuts threadedly received on said threaded second portion for receiving said tiller end cap therebetween.

9. In combination:

a catamaran rudder assembly comprising a rudder, a hinge and hinge pin for attaching said rudder to the transom of a catamaran, a tiller secured to said rudder and having a tiller end cap thereon;

a crossbar having a crossbar end cap; and a tiller-crossbar connector connecting together said end caps, said tiller-crossbar connector comprising:

a recess in said crossbar end cap;

a central shaft member extending through said crossbar end cap;

a part spherical pivot member slidably received by said central shaft member adjacent one end of said central shaft member;

means for anchoring said central shaft member to said tiller end cap; and spring means disposed about said central shaft member and acting between said tiller end cap and said crossbar end cap to urge said pivot member into said end cap recess; and said central shaft member having a first portion of a smooth cylindrical surface and a second portion externally threaded, said first portion extending through said part-spherical pivot member, and said first and second portions having axes which are arranged at an angle to one another.

10. The combination of claim 9 wherein each end cap includes a recess and each said recess being a generally hemispherical recess, wherein said part-spherical member has a spherical diameter larger than the spherical diameter of the recess of said crossbar end cap such that said part-spherical member makes other than equatorial line contact with said recess.

11. The combination of claim 10 wherein said second portion extends through said tiller end cap, said first portion and said second portion being arranged relative to each other such that the cylindrical axis of said first portion is located in a conical tolerance zone, the axis of said zone being substantially parallel to the axis of rudder rotation about said hinge pin.

12. The combination of claim 11 wherein said central shaft member has an enlarged head at one end adjacent said part-spherical pivot member and a nut threadedly received on the opposite end adjacent said tiller end cap, the entire combination being securely clamped to said tiller end cap by means of said nut on said central shaft member.

13. The combination of claim 11 wherein the frictional forces between said crossbar end cap and the exterior of said spherical pivot member are greater than the frictional forces between said first portion and the interior of said part-spherical pivot member under a spring-loaded force exerted by said spring means.

14. The apparatus of claim 9 wherein said means for anchoring comprising a pair of nuts threadedly received on said second portion on opposite sides of said tiller end cap.

* * * * *